United States Patent [19]

Gelsdorf et al.

[11] 4,174,970

[45] Nov. 20, 1979

[54] REFRACTORY COMPOSITION

[75] Inventors: Günter Gelsdorf, Nordenstadt; Friedhelm Wirth, Siershahn, both of Fed. Rep. of Germany

[73] Assignee: Didier-Werke A.G., Fed. Rep. of Germany

[21] Appl. No.: 901,837

[22] Filed: May 1, 1978

[30] Foreign Application Priority Data

May 20, 1977 [DE] Fed. Rep. of Germany ..... 2722903

[51] Int. Cl.[2] ..... C04B 35/56

[52] U.S. Cl. ..... 106/44; 106/56; 106/66

[58] Field of Search ..... 106/44, 43, 56, 66

[56] References Cited

U.S. PATENT DOCUMENTS

| | | | |
|---|---|---|---|
| 2,764,491 | 9/1956 | Silverberg | 106/44 |
| 3,753,744 | 8/1973 | Komaru et al. | 106/44 |
| 3,892,584 | 7/1975 | Takeda et al. | 106/44 |
| 4,061,501 | 12/1977 | Ivarsson et al. | 106/44 |

*Primary Examiner*—James Poer

*Attorney, Agent, or Firm*—Wenderoth, Lind & Ponack

[57] ABSTRACT

Improved refractory compositions for the production of blast furnace pouring ducts are realized by the inclusion of $Cr_2O_3$ in said compositions.

11 Claims, No Drawings

REFRACTORY COMPOSITION

The invention relates to refractory compositions and more specifically to refractory compositions useful for the production of pouring ducts for blast furnaces.

Conventional materials for blast furnace pouring ducts, taps, spouts, runner, gutters and main flues consist of a refractory material and an appropriate binding agent.

These compositions are formed by appropriate tamping or molding, for example, by means of a die.

The conventional spouts must be replaced or repaired from time to time as a consequence of wear. In particular, blast furnace pouring ducts made of such conventional materials are eroded, especially when in contact with slag. This is believed to be due to an insufficient resistance to the slag and to the fact that the ducts made by conventional materials are effectively wetted by the slag.

The conventional refractory materials for the production of these pouring ducts for blast furnaces contain a mixture of one or more of fire clay (chamotte) or sand as well as coke, with clay as a binder and water. For example, it is conventional to fabricate such materials from sand, coke and/or tar.

It has also been attempted to produce suitable materials by employing refractory materials containing high proportions of aluminum oxide.

Attempts have also been made to extend the service life of such materials by the introduction of large proportions of silicon carbide and carbon-containing materials such as hard pitch, as disclosed in German Auslegeschrift No. 24 14 965.

However, all of these prior art attempts have been deficient in one or more respects.

It is therefore an object of the present invention to provide materials for the production of blast furnace pouring ducts which are more stable than the known materials with respect to resistance to attack by slag.

These and other objects are realized by the present invention which employs the above-mentioned conventional components and in addition, 0.1 to 3% by weight of fine chromic oxide, based on the total weight of the dry components.

The chromic oxide employed preferably has a maximum particle size of 0.063 millimeters.

The chromic oxide employed in the present invention is the so-called chromium sesquioxide $Cr_2O_3$, which is a green powder in the ordinary state.

The conventional refractory materials employed in the present invention are, for example, quartz or a predominantly alumina-containing material such as corundum, bauxite, fire clay or pyrophyllite.

As binders, one may employ the conventional binders such as the special so-called bonding clays, sulfite waste liquors ordinarily employed in the field of refractory materials or binders having a chemical bonding effect such as phosphoric acid, water glass, boric acid or salts thereof.

The basic compositions of the present invention further contain silicon carbide which is conventionally employed in the production of materials for blast furnace ducts.

As exemplary of carbon-containing materials conventionally employed, there may be mentioned tar or hard pitch as well as graphite and coke breeze. When tar or hard pitch is employed, these may simultaneously act as binders.

In the preparation of refractory materials, the optional use of a plasticizer, pressing agent or plurality of such plasticizers or agents may be employed. Such materials are commercially available substances which lower the interfacial tension.

Conventional proportions of the above-mentioned components are employed in the present compositions. For example, the fraction of the conventional refractory components may range from about 20 to 70% by weight; the fraction of silicon carbide from about 5 to 30% by weight, the fraction of carbon-containing material from 5 to about 15% by weight and the binder fraction from about 1 to 15% by weight, depending on the type of binder. The plasticizer fraction is generally low and amounts to about 0.1 to 2% by weight when employed.

The above-mentioned percentages relate in each case to the total weight of the dry components, i.e. to all components except water, with tar being considered as a dry component.

The above-described compositions are the so-called plastic or tamping masses, i.e. they are mixed with 4 to 12% by weight water and can then be stored for as long as a year.

The grain size of these conventional components for pouring ducts is the customary range; their grain structure is selected such that the materials can readily be subjected to optimal compression. A maximum grain size is generally about 6 or 8 mm for the customary refractory components, e.g. fire clay or pyrophyllite, while silicon carbide is generally employed within the grain size of above 0 to 3 mm and advantageously, above 0 to 2 mm. Corundum, if present, is employed in a grain size of above 0 to 1 mm and advantageously from above 0 to 0.5 mm. The graphite is ordinarily employed in the form of a graphite powder, i.e. with a grain size below 0.2 mm. If coke breeze is employed as a carbon-containing material, it generally possesses a grain size of above 0 to 3 mm and advantageously, above 0 to 2 mm.

In a preferred embodiment, wherein the materials contain 5 to 30% by weight silicon carbide, at least 5% by weight and preferably at least 10% by weight of the silicon carbide is in the form of a powder or dust having a grain size below 0.63 mm. This fraction of silicon carbide powder or silicon carbide dust of below 0.63 mm advantageously is not present in an amount more than 30% by weight of the total silicon carbide present.

When there is employed a commercial silicon carbide having a grain size above 0 to 2 mm and containing, for example, only about 2.5% by weight as a powder or dust having a grain size below 0.63 mm, then it is necessary to add a portion of silicon carbide in the form of a powder or dust to realize the above-mentioned, preferred materials of the invention.

The following table indicates by way of example the compositions of the prior art which are identified as Material Nos. 1 and 2 as well as a composition of the present invention which is identified as Material 3.

In Example 3, for the material of the present invention, there is employed silicon carbide having a grain size of above 0 to 2 mm, with 25% by weight of the silicon carbide being in the form of a powder having a grain size of below 0.063 mm. The hard pitch employed had a softening point of 140° C. as determined by the Kraemer-Sarnow method. The graphite powder had a maximum grain size of 0.5 mm, with more than 80% by weight having a grain size below 0.12 mm. The clay was first worked into a slip with a portion of the water added to the material and it was introduced as such into the composition. The material of the invention was prepared in the ordinary manner in a kneading mixer, e.g. a double arm mixer, so that there was obtained a plastic material which could be worked through tamping.

TABLE

| Composition | Material #1 (% by weight) | Material #2 % by weight) | Material #3 % by weight) |
|---|---|---|---|
| Chamotte | | 35-65 | |
| Bauxite | 30-70 | | 61 |
| Corundum | | 5-20 | |
| SiC | 5-20 | 10-25 | 20 |
| Carbon-containing material | 5-30 | | |
| hard pitch | | | 2 |
| graphite | | 4-10 | 6 |
| $Cr_2O_3$ | | | 1 |
| Clay ($Al_2O_{3\ 38/40}$) | 5-25 | 10-20 | 10 |
| Plasticizer (additive) | | 0.5 | 0.1 |
| Water added | 4-12 | 5-8 | 6.5-7.5 |

The materials of the present invention, i.e. Material No. 3, contained 1% by weight of $Cr_2O_3$. Further, there was prepared a modification of Material No. 3 wherein the $Cr_2O_3$ fraction was replaced by 1% by weight of fine-grained bauxite. Both of these materials were employed for lining a slag separator (flue) constructed on the surface of a crude iron tap spout of a blast furnace. The material of the present invention provided a 30% increase in the service life, measured on the throughput quantity of the crude iron. This result is thought to be due to the fact that the material containing free $Cr_2O_3$ is wetted to a lesser extent by the slag and consequently, it is more resistant to the slag and in particular to slag erosion.

It is apparent that numerous modifications and variations are possible in view of the foregoing disclosure without departing from the spirit and scope of the invention.

We claim:

1. In a refractory composition for blast furnace pouring ducts which comprises: silicon carbide in an amount of 5 to 30% by weight, a predominantly carbon-containing material, refractory components, a binder and water, with or without a plasticizer, the improvement wherein said composition additionally comprises 0.1 to 3% by weight of fine $Cr_2O_3$ based on the total weight of the dry components.

2. The composition of claim 1 wherein said $Cr_2O_3$ is present in an amount of 0.5-2% by weight.

3. The composition of claim 1 wherein said $Cr_2O_3$ possesses a maximum particle size of 0.063 mm.

4. The composition of claims 1, 2 or 3 wherein at least 5% by weight of the SiC present is in the form of powder having a grain size smaller than 0.063 mm.

5. The composition of claims 1, 2 or 3, wherein at least 10% by weight of the SiC present is in the form of powder having a grain size smaller than 0.063 mm.

6. The composition of claims 1, 2 or 3 wherein up to 30% by weight of SiC is present in the form of powder having a grain size smaller than 0.063 mm.

7. The refractory composition of claim 1 wherein said refractory components are one or more selected from the group consisting of quartz and alumina containing materials.

8. The refractory composition of claim 7 wherein said alumina containing materials are selected from the group consisting of corundum, bauxite, fireclay and pyrophyllite.

9. The refractory composition of claims 7 or 8 wherein the binder is selected from the group consisting of bonding clays, sulfite water liquors, phosporic acid, water glass and boric acid or salts thereof.

10. The refractory composition of claims 7 or 8 wherein said predominantly carbon containing material is selected from the group consisting of tar, hard pitch, graphite or coke breeze.

11. The refractory composition of claim 9 wherein said predominantly carbon containing material is selected from the group consisting of tar, hard pitch, graphite or coke breeze.

* * * * *